US006789974B2

(12) United States Patent
Atkinson et al.

(10) Patent No.: US 6,789,974 B2
(45) Date of Patent: Sep. 14, 2004

(54) METHOD AND TOOL FOR APPLYING PINSTRIPING

(76) Inventors: Philip Lee Atkinson, 1100 Brook Ridge Ave., Allen, TX (US) 75002; Kenneth C. Dingle, III, 17610 W. Strack Dr., Spring, TX (US) 77379

( * ) Notice: Subject to any disclaimer, the term of this patent is extended or adjusted under 35 U.S.C. 154(b) by 0 days.

(21) Appl. No.: 10/313,159

(22) Filed: Dec. 6, 2002

(65) Prior Publication Data

US 2003/0086746 A1 May 8, 2003

(51) Int. Cl.[7] ..... B05C 17/00; A46B 11/00; B43K 29/00; B43M 11/06

(52) U.S. Cl. ..... 401/208; 401/48; 401/193; 401/183

(58) Field of Search ..... 401/208, 218, 401/219, 220, 48, 193, 183, 124, 135; 118/207, 208

(56) References Cited

U.S. PATENT DOCUMENTS 1,830,860 A * 11/1931 Scoles ..... 401/218
1,988,710 A 1/1935 Beugler
2,582,861 A * 1/1952 Coombs ..... 401/208
2,721,347 A * 10/1955 Benkowski ..... 401/219
3,448,722 A * 6/1969 Krizman ..... 118/207

* cited by examiner

*Primary Examiner*—David Walczak
(74) *Attorney, Agent, or Firm*—Jack D. Stone, Jr.

(57) ABSTRACT

A paint striper has a main body having a head portion, an interior cavity, and a slot in fluid communication between the head portion and the interior cavity. The slot is configured for receiving a wheel, and the interior cavity is configured for receiving paint. A wheel is rotatably mounted in the slot with a portion of the wheel extending into the interior cavity. A shoulder extends from the main body, and a guide extends from the shoulder for following a guide track formed in a strip positioned on a surface of the vehicle, wherein the track is substantially parallel to the desired position of the pinstripe. The strip is secured in position on the surface of the vehicle using adhesive which permits removal of the strip from the surface of the vehicle without leaving a residue, and re-use of the strip on a surface of another vehicle.

23 Claims, 6 Drawing Sheets

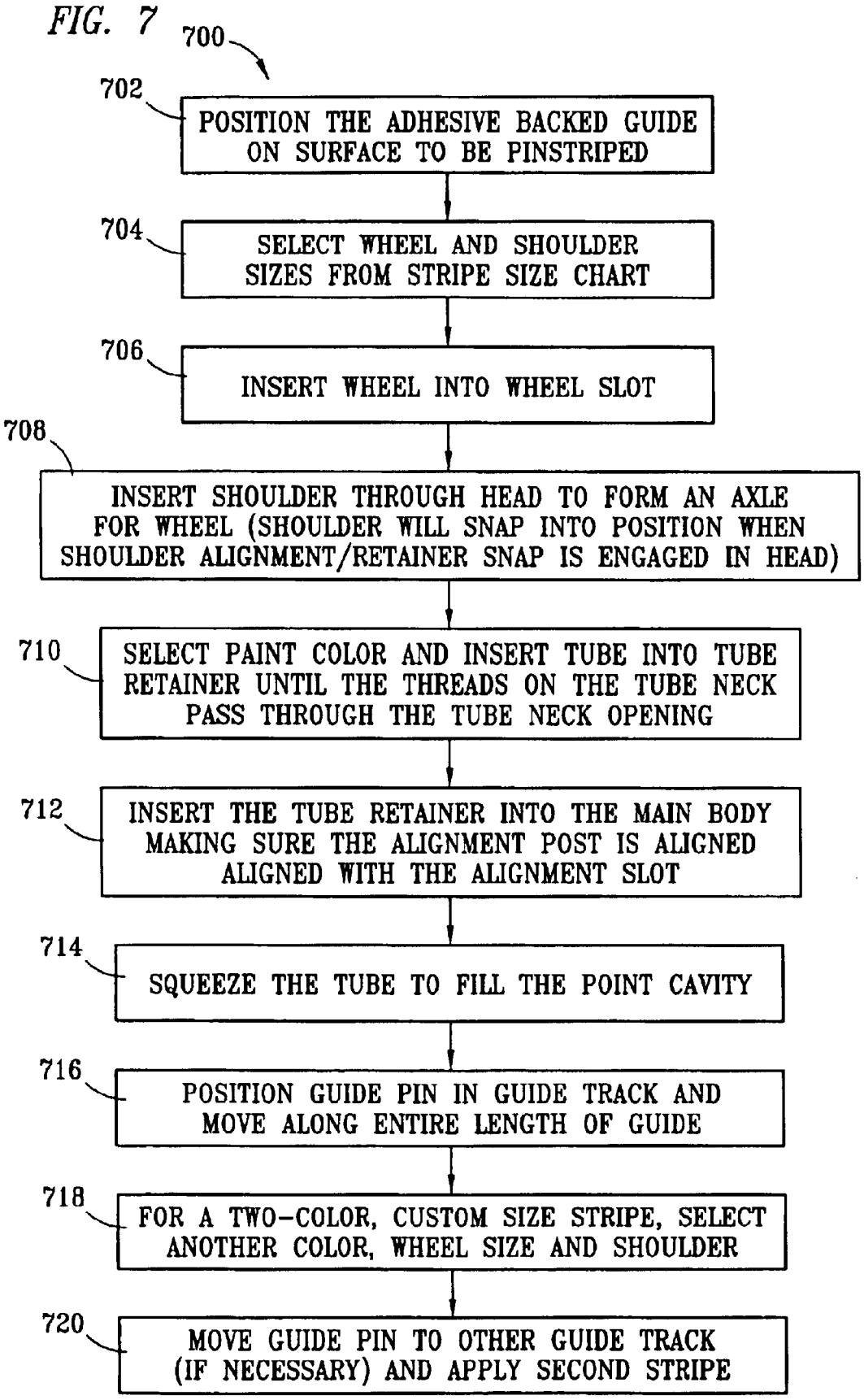
FIG. 7
700
702
POSITION THE ADHESIVE BACKED GUIDE ON SURFACE TO BE PINSTRIPED
704
SELECT WHEEL AND SHOULDER SIZES FROM STRIPE SIZE CHART
706
INSERT WHEEL INTO WHEEL SLOT
708
INSERT SHOULDER THROUGH HEAD TO FORM AN AXLE FOR WHEEL (SHOULDER WILL SNAP INTO POSITION WHEN SHOULDER ALIGNMENT/RETAINER SNAP IS ENGAGED IN HEAD)
710
SELECT PAINT COLOR AND INSERT TUBE INTO TUBE RETAINER UNTIL THE THREADS ON THE TUBE NECK PASS THROUGH THE TUBE NECK OPENING
712
INSERT THE TUBE RETAINER INTO THE MAIN BODY MAKING SURE THE ALIGNMENT POST IS ALIGNED ALIGNED WITH THE ALIGNMENT SLOT
714
SQUEEZE THE TUBE TO FILL THE POINT CAVITY
716
POSITION GUIDE PIN IN GUIDE TRACK AND MOVE ALONG ENTIRE LENGTH OF GUIDE
718
FOR A TWO-COLOR, CUSTOM SIZE STRIPE, SELECT ANOTHER COLOR, WHEEL SIZE AND SHOULDER
720
MOVE GUIDE PIN TO OTHER GUIDE TRACK (IF NECESSARY) AND APPLY SECOND STRIPE

METHOD AND TOOL FOR APPLYING PINSTRIPING

TECHNICAL FIELD

The invention relates generally to pinstriping and, more particularly, to a method and tool for applying pinstriping to vehicles.

BACKGROUND

Purchasers and owners of vehicles, such as automobiles and trucks, often desire to improve the appearance of their vehicle by pinstriping their vehicles, or portions of their vehicles. This may be achieved by manually applying with a paint brush a pinstripe onto the vehicle. It is very difficult though to obtain consistent, high-quality results from manually painting a pinstripe onto a vehicle. Moreover, such technique is also very time-consuming.

In an attempt to improve the quality of pinstripe, a roller device has been developed, as described, for example, in U.S. Pat. No. 1,988,710 entitled "Striper" which issued to Samuel B. Beugler on Jan. 22, 1935. Such roller device is used in lieu of a brush and includes a removable closure cap having a slot through which a striping wheel rotates in a manner such that all of the paint adhering to the wheel, after it has engaged the surface being pinstriped, is carried back into the barrel. The device further includes a guide bar extending from the device for insertion in a guide strip. The guide strip is preferably magnetic so that it may be positioned on a vehicle with a metallic surface, and includes a groove configured for receiving the guide bar. In operation, the guide bar is positioned in the groove of the guide strip, and the device is moved along the guide strip as the wheel of the device is rolled with paint along the surface of the vehicle, thereby applying paint to the vehicle in a relatively straight line.

There are a number of drawbacks associated with using the Beugler roller device to apply a pinstripe to the surface of a vehicle. For example, the guide bar is difficult to maintain in the groove of the guide strip while moving the device along the strip. Furthermore, since the guide strip relies on magnetism to attach to the vehicle, the strip may not be used with vehicles having non-metallic surfaces, such as fiberglass, composites, and the like.

In another attempt to cure the drawbacks associated with conventional techniques for applying pinstriping, stencils have been developed in which a pinstripe is applied to the surface of a vehicle by painting within the bounds provided by the stencil. There are a number of drawbacks associated with using stencils also. For example, stencils are difficult to use under windy weather conditions, because a stencil will tend to not stay lined up on a vehicle as it should to permit a pinstripe to be applied. A stencil will also tend to bubble up on a hot car surface, permitting paint to bleed through the edges of the pinstripe. A stencil also requires more paint to make a pinstripe than any other method available for pin striping. It is also difficult to make a tip with a stencil, a pinstripe with multiple lines and/or colors, or to remove a stencil from a vehicle without getting paint on any other part of the vehicle. As a result of the foregoing, stencils are relatively time-consuming and more expensive than other methods.

While pinstriping technology has evolved, substantial skill, experience, and time is still required to apply a pinstripe to a vehicle with consistent high-quality. Accordingly, a continuing search has been directed to the development of methods and tools by which people, with or without substantial experience, may apply pinstriping to a vehicle in a reasonable amount of time with consistent high-quality.

SUMMARY

The present invention, accordingly, provides an improved pin stripping tool and method having a main body comprising a head portion, an interior cavity, and a slot in fluid communication between the head portion and the interior cavity. The slot is configured for receiving a wheel, and the interior cavity is configured for receiving paint. A wheel is rotatably mounted in the slot with a portion of the periphery of the wheel extending into the interior cavity. A shoulder extends from the main body, and a guide extends from the shoulder, the guide being configured for following a guide track formed in a strip positioned on a surface of the vehicle, wherein the track is substantially parallel to the desired position of the pinstripe.

In a further embodiment, the strip is secured in position on the surface of the vehicle using adhesive which permits removal of the strip from the surface of the vehicle without leaving a residue, and re-use of the strip on a surface of another vehicle.

BRIEF DESCRIPTION OF THE DRAWINGS

For a more complete understanding of the present invention, and the advantages thereof, reference is now made to the following description taken in conjunction with the accompanying drawings, in which:

FIG. 7 is a flowchart of steps for applying a pinstripe in accordance with the present invention;

DETAILED DESCRIPTION

Figure 1:
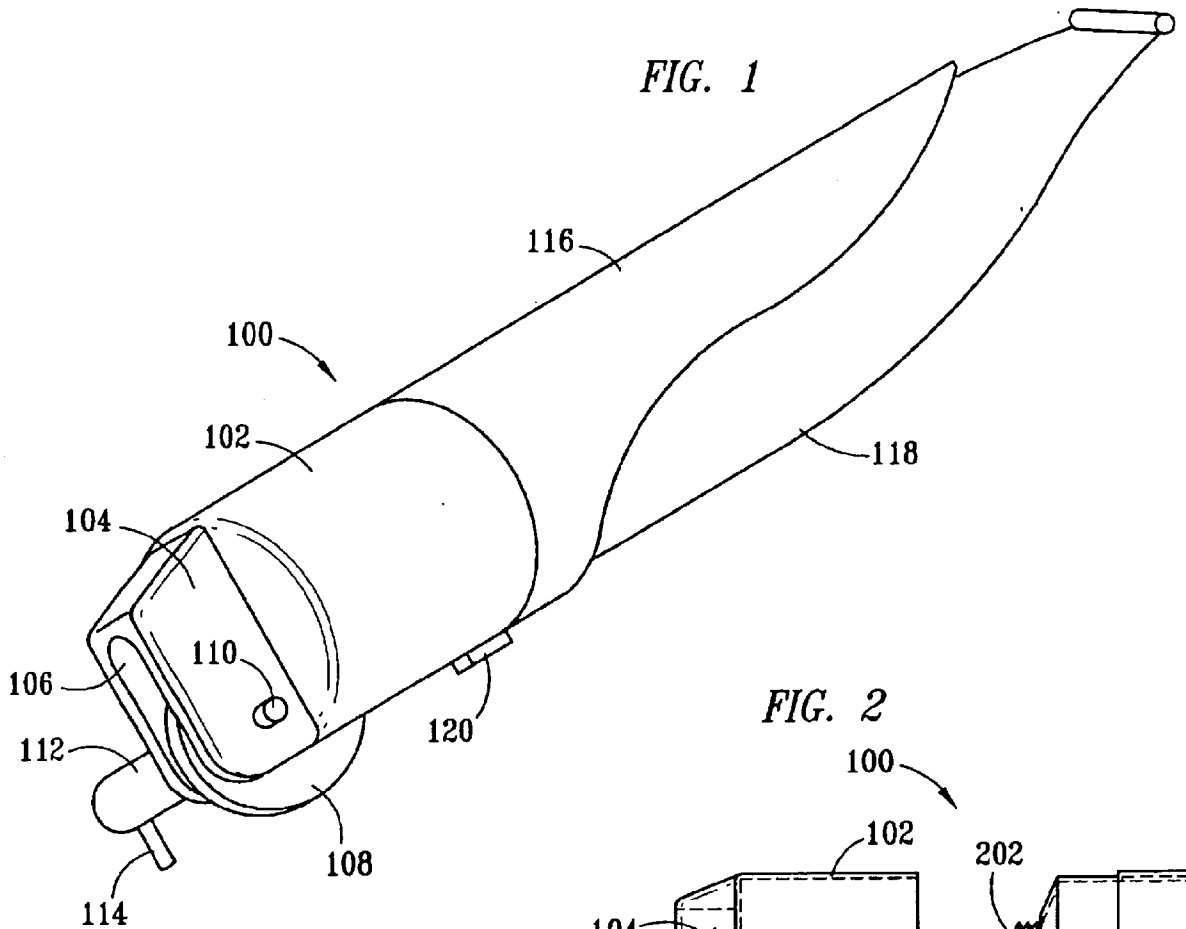
FIG. 1 is a perspective view of a pin striping tool embodying features of the present invention.

In the following discussion, numerous specific details are set forth to provide a thorough understanding of the present invention. However, it will be obvious to those skilled in the art that the present invention may be practiced without such specific details. In other instances, well-known elements have been illustrated in schematic or block diagram form in order not to obscure the present invention in unnecessary detail. Additionally, for the most part, details concerning paint and the like have been omitted inasmuch as such details are not considered necessary to obtain a complete understanding of the present invention, and are considered to be within the skills of persons of ordinary skill in the relevant art.

Refer now to the drawings wherein depicted elements are, for the sake of clarity, not necessarily shown to scale and wherein like or similar elements are designated by the same reference numeral through the several views.

Referring to FIG. 1 of the drawings, the reference numeral 100 generally designates a pinstriping tool embodying features of the present invention. As described in further detail below, the tool 100 includes a main body 102 comprising a head 104. The head 104 defines an opening 106 and a slot (not shown in FIG. 1) formed therein and configured for receiving a wheel 108. The wheel 108 is rotatably secured therein via an axle 110 extending from a shoulder 112 positioned in the head 104. A guide pin 114 extends downwardly (as viewed in FIG. 1) from the shoulder 112 for insertion in a guide (shown and discussed below with respect to FIGS. 4–6). The main body 102 is further configured for receiving a tube retainer 116. The tube retainer 116 is configured for holding a tube 118 containing paint to be applied to form a pinstripe on a surface of a vehicle (not shown in FIG. 1). The tube retainer 116 also includes a post 120 configured for mating with a corresponding alignment slot (not shown in FIG. 1). While the post 120 and corresponding alignment slot are preferred, the pinstriping tool 100 may optionally be fabricated without them.

Figure 2:
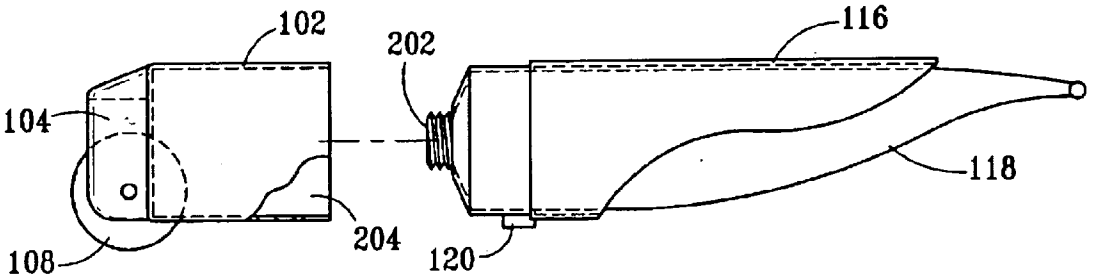
FIG. 2 is a side elevation view of the tool of FIG. 1.

FIG. 2 shows a side elevation view of the pinstriping tool 100 of FIG. 1, with the tube retainer 116 removed. As shown therein, the tube of paint 118 includes a tube neck 202 which extends into a cavity 204 of the main body 102 for facilitating the communication of paint from the tube 118 to the main body 102.

Figure 3:
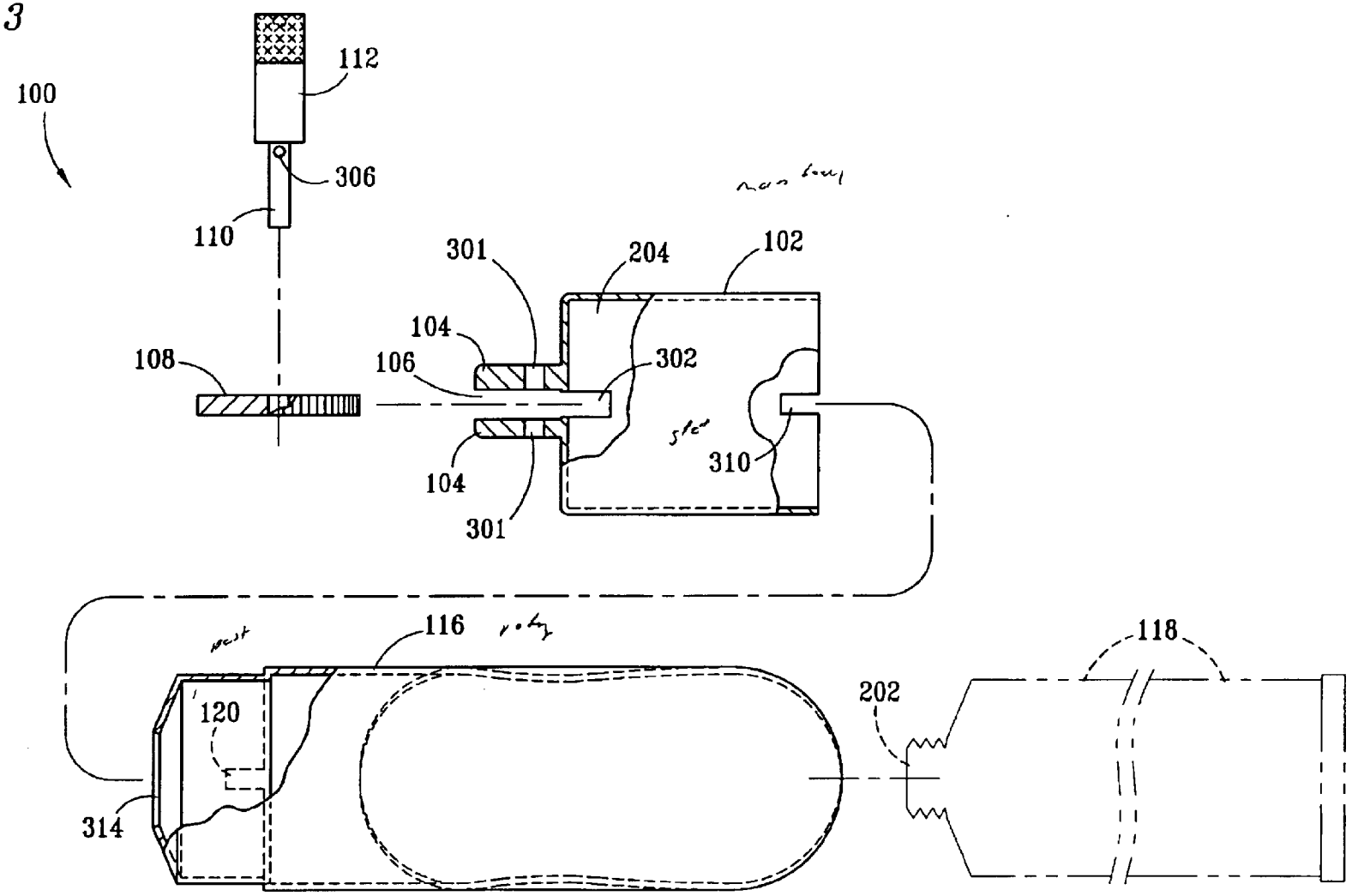
FIG. 3 is an exploded view of the tool of FIG. 1.

FIG. 3 shows an exploded view of the pinstriping tool 100. As shown, the head portion 104 includes a race opening 301 configured for receiving the axle 110. The axle 110 includes a raised portion 306 configured for snapping into a corresponding detent 308 formed in the race opening 301 for securing the axle 110 in the race opening 301. As depicted in FIG. 3, a slot 302 is defined by the head 104 through which a portion of the periphery of the wheel 108 extends into the cavity 204. An alignment slot 310 is formed in the main body 102 for receiving the post 120. The tube retainer 116 defines a tube neck opening 314 for receiving the tube neck 202.

Figure 4:
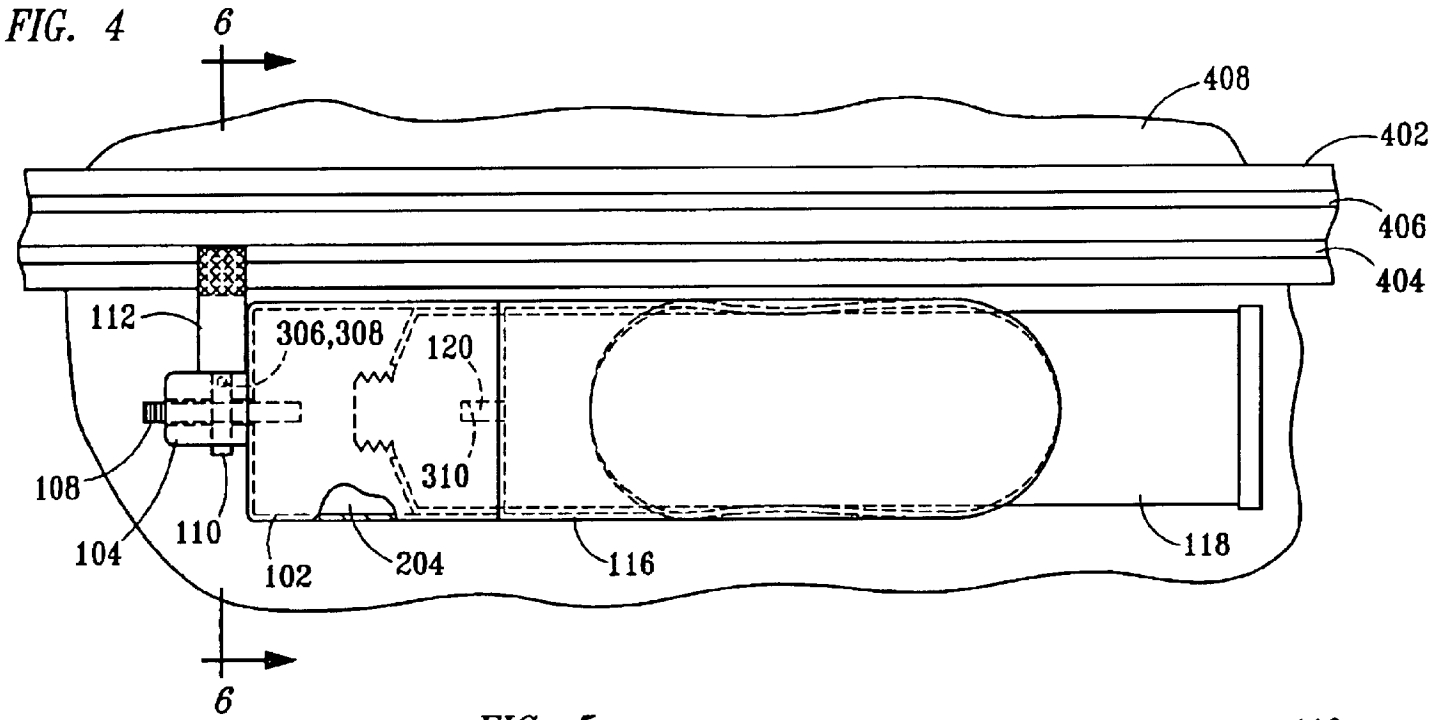
FIG. 4 is a plan view of the tool of FIG. 1 shown in operation.
Figure 5:
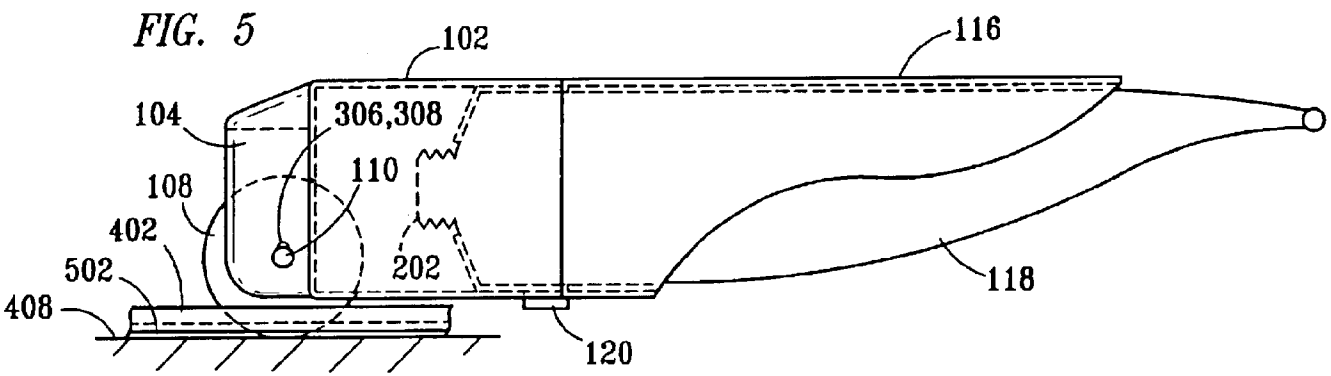
FIG. 5 is a side elevation view of the tool of FIG. 4.
Figure 6:
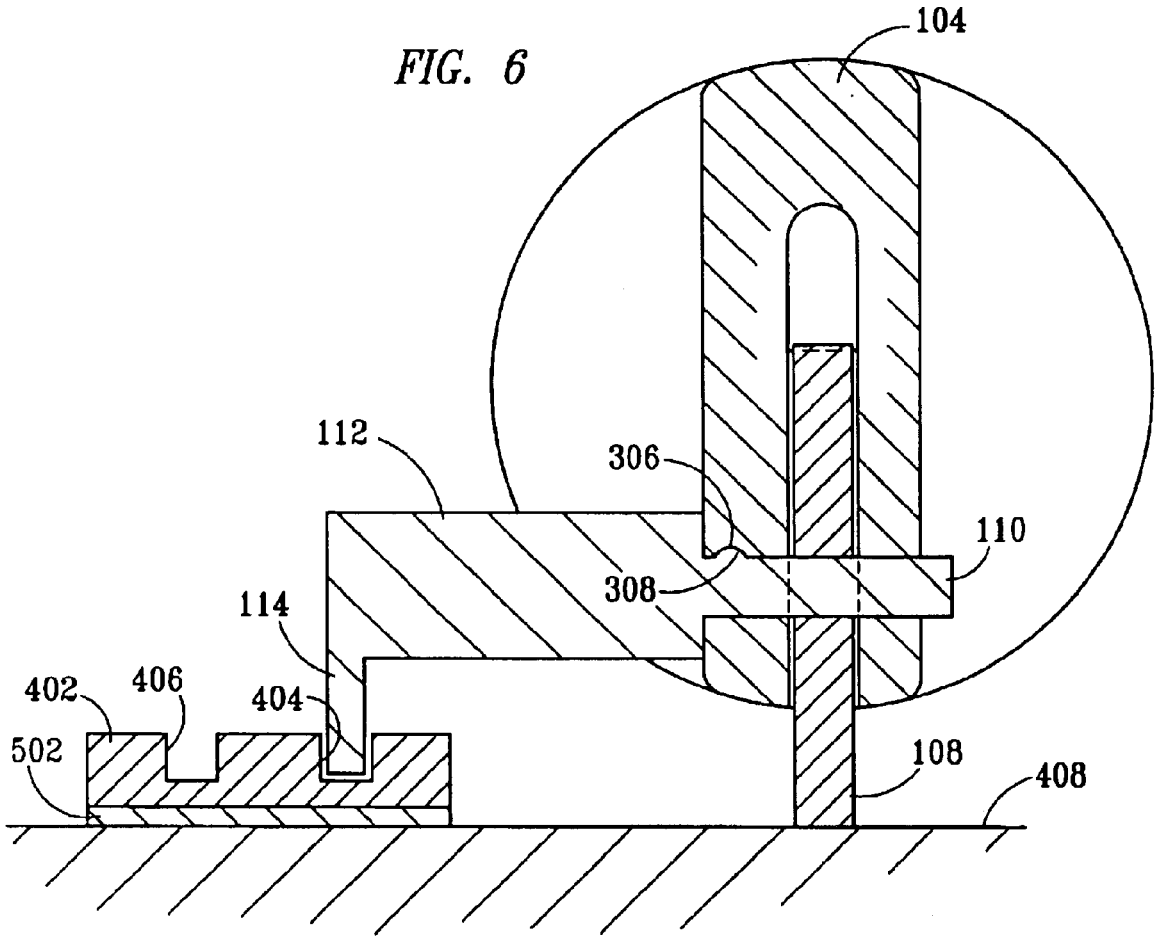
FIG. 6 is a front elevation view of the tool of FIG. 4.

FIGS. 4–6 exemplify how the pinstriping tool 100 may be set up for operation. Preferably, an adhesive-backed guide 402 is positioned on a surface 408 of a vehicle. The guide 402 preferably includes a double sided adhesive strip 502 that is effective within a temperature range of from 40°–160° F. for adhering the guide 402 to a surface of a vehicle, and for being removed from the vehicle surface without leaving a residue, so that it may be re-used on a surface of another vehicle. By way of example, such an adhesive strip 502 is commercially available from PluStar, located in Dallas, part number 14375. The guide 402 preferably includes two tracks 404 and 406, such as grooves or ridges, formed therein for allowing the guide pin 114 to ride therein. Optionally, the guide 402 may include only a single track 404 for facilitating work in tight-fitting areas, such as under door mirrors, and the like, wherein multiple spaced-apart pinstripes may be applied by using multiple guide pins 114 extending from shoulders 112 of varying lengths. Alternatively, the guide 402 may include multiple tracks, such as three or four tracks similar to the tracks 404 and 406, to permit a single guide pin 114 and shoulder 112 to be used in the application of a corresponding number of spaced-apart pinstripes, thereby rendering it unnecessary to switch out guide pins 114 and shoulders 112 of varying lengths for each of multiple pinstripes.

Steps of operating the pin-striping tool 100 are depicted in FIG. 7. At step 702, the guide 402 is positioned on the surface 408 via the adhesive-backed strip 502. At step 704, a wheel 108 and shoulder 112 are selected, preferably using a pinstripe size chart (not shown). At step 706, the wheel 108 is inserted into the opening 106 and slot 302 and, at step 708, is secured in place by inserting the axle 110 through the opening 106 until the raised portion 306 snaps into place in the corresponding detent 308 of the race opening 301.

At step 710, a paint color is selected and a tube 118 of paint of such color is inserted into the tube retainer 116 until the tube neck 202 passes through the tube neck opening 314. At step step 712, the tube retainer 116 is positioned into the main body 102, such that the alignment post 120 is preferably received by the alignment slot 310. At step 714, the tube 118 of paint is manually squeezed until paint is communicated into the cavity 204.

At step 716, the tool 100 is positioned on the vehicle surface 408 so that the guide pin 114 aligns with the track 404, and the wheel 108 touches the surface 408. The tool 100 is then moved with the guide pin following the track 404, and the wheel 108 rotating and carrying paint from the cavity 204 to the surface 408, thereby forming a pinstripe on the surface 408 of the vehicle. In accordance with step 718, the steps 702–716 may be repeated, but with a paint of a different color and/or a different wheel 108 and/or size of shoulder 112. In accordance with step 720, the steps 702–718 may be repeated using a different track, such as a track 406 to apply a pinstripe spaced-apart from a pinstripe applied using the track 404. If the guide 402 includes any additional tracks (not shown) similar to the tracks 404 and 406, then the steps 702–718 may be similarly repeated to apply additional pinstripe using the additional tracks.

Figure 8:
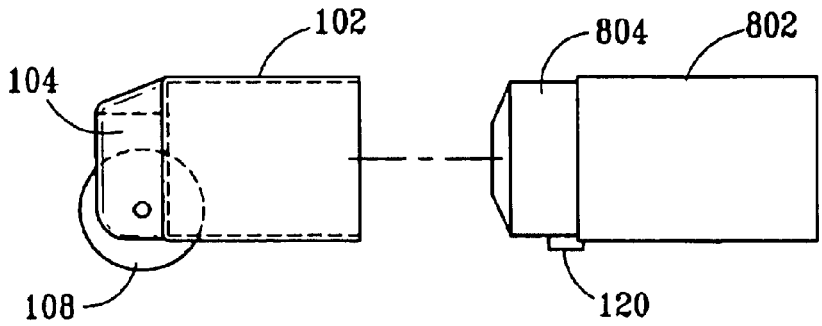
FIG. 8 is an alternate embodiment of the present invention.

The embodiment of FIG. 8 is similar to the embodiment of FIGS. 1–6, and identical components are given the same reference numerals. According to the embodiment of FIG. 8, a tube retainer 804 is adapted for receiving a solid stick of paint 802 which is communicated (e.g., via a plunger, not shown, at one end of the tube) into the cavity 204. Operation of the embodiment of FIG. 8 is otherwise performed in accordance with the steps depicted above with respect to FIG. 7.

Figure 9:
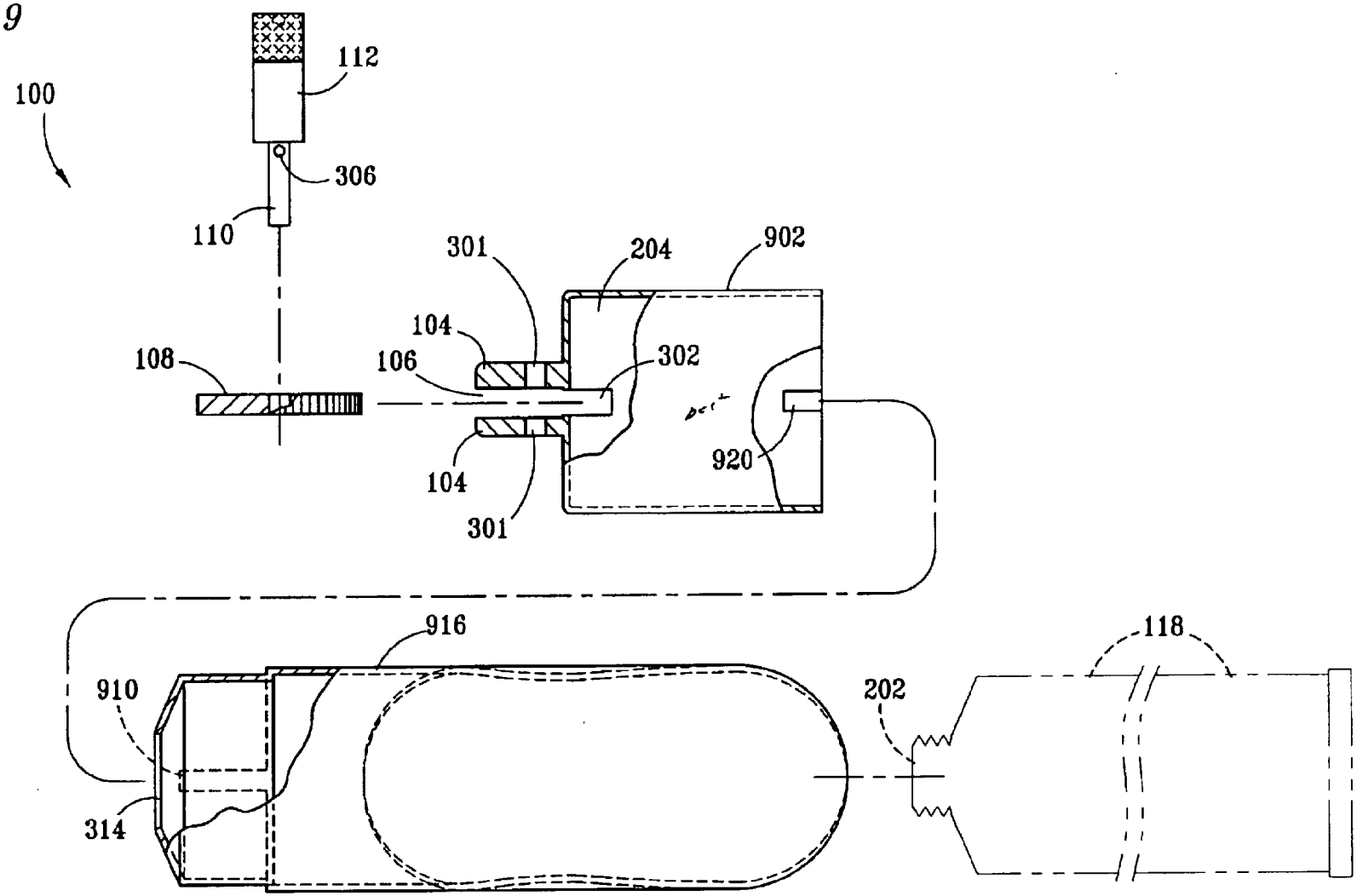
FIG. 9 is a second alternate embodiment of the present invention.

The embodiment of FIG. 9 is similar to the embodiment of FIGS. 1–6, and identical components are given the same reference numerals. According to the embodiment of FIG. 9, a post 920 (similar to post 120) is formed on the main body 902 otherwise similar to the main body 102) to thereby replace the slot 310, and a slot 910 (similar to slot 310) is formed in a tube retainer 916 otherwise similar to tube retainer 116) to thereby replace the post 120. The slot 910 and post 920 are matingly configured. Operation of the embodiment of FIG. 9 is otherwise performed in accordance with the steps depicted above with respect to FIG. 7.

It is understood that the present invention may take many forms and embodiments. Accordingly, several variations may be made in the foregoing without departing from the spirit or the scope of the invention. For example, the strip 502 may be fabricated from magnetic material for removably securing the strip and guide 402 to a metallic surface of said vehicle. Foam tape may be secured to the strip 502 and include adhesive for removably adhering the strip 502 and guide 402 to the surface of a vehicle, the adhesive preferably being effective within a temperature range of at least 40° to 160° Fahrenheit, and preferably being removable without leaving a residue on said surface of said vehicle. The guide 402 may be fabricated from plastic. The tracks 404 and 406 defined within the guide 402 may also be magnetized for facilitating travel of the guide pin 114 within the grooves. The guide 402 may be replaced with thin foam or an adhesive tape guide having a thin wire or string to form a raised ridge track on a surface thereof for guiding the guide pin 114 and pinstriping tool 100. Another type of striping instrument or tool, such as a brush, may configured to utilize the tracks 404 and 406 of the guide 402.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A pin striping tool configured for applying a pinstripe onto a vehicle, said tool comprising:

a main body having a head portion, an interior cavity, and a slot in fluid communication between the head portion and the interior cavity of said main body, said slot being configured for receiving a wheel, said interior cavity being configured for receiving paint;

a wheel rotatably mounted in said slot with a portion of the periphery of said wheel extending into said interior cavity;

a shoulder extending from said main body;

a guide positioned on a surface of said vehicle, said guide having a strip comprising adhesive for removably adhering said guide to the surface of said vehicle; and a guide pin extending from said shoulder, said guide pin being configured for riding at least one guide track formed in said guide, said at least one track defining a groove and being substantially parallel to the desired position of said pinstripe.

2. The tool of claim 1 further comprising a tube retainer attachable to said main body, said retainer being configured for receiving a tube of paint and for facilitating communication of said paint from said tube to said interior cavity of said main body.

3. The tool of claim 1 further comprising a tube retainer attachable to said main body, said retainer being configured for receiving a tube of paint and for facilitating communication of said paint from said tube to said interior cavity of said main body, said tube being further deformable for facilitating the manual application of pressure to induce the communication of paint from the tube to said interior cavity of said main body.

4. The tool of claim 1 further comprising a tube retainer attachable to said main body, said retainer and said main body being configured with a post and corresponding alignment slot for aligning said tube retainer with said main body, said retainer being further configured for receiving a tube of paint and for facilitating communication of said paint from said tube to said interior cavity of said main body, said tube being squeezably deformable for facilitating the manual application of pressure to induce the communication of paint from the tube to said interior cavity of said main body.

5. The tool of claim 1 further comprising a tube attachable to said main body, said tube being configured for containing paint and for communicating paint from the tube to said interior cavity of said main body.

6. A pin striping tool configured for applying a pinstripe onto a vehicle, said tool comprising:

a main body having a head portion, an interior cavity, and a slot in fluid communication between the head portion and the interior cavity of said main body, said slot being configured for receiving a wheel, said interior cavity being configured for receiving paint;

a wheel rotatably mounted in said slot with a portion of the periphery of said wheel extending into said interior cavity;

a shoulder extending from said main body;

a guide positioned on a surface of said vehicle, said guide having a strip comprising foam tape which is secured to said strip and includes adhesive for removably adhering said guide to the surface of said vehicle;

a guide pin extending from said shoulder, said guide pin being configured for riding at least one guide track formed in said guide, said at least one track defining a groove and being substantially parallel to the desired position of said pinstripe.

7. A pin striping tool configured for applying a pinstripe onto a vehicle, said tool comprising:

a main body having a head portion, an interior cavity, and a slot in fluid communication between the head portion and the interior cavity of said main body, said slot being configured for receiving a wheel, said interior cavity being configured for receiving paint;

a wheel rotatably mounted in said slot with a portion of the periphery of said wheel extending into said interior cavity;

a shoulder extending from said main body;

a guide positioned on a surface of said vehicle, said guide having a strip comprising foam tape which is secured to said strip and includes adhesive for removably adhering the guide to the surface of said vehicle, said adhesive being effective within a temperature range of at least 40° to 160° Fahrenheit, and being removable without leaving a residue on said surface of said vehicle;

a guide pin extending from said shoulder, said guide pin being configured for riding at least one guide track formed in said guide, said at least one track defining a groove and being substantially parallel to the desired position of said pinstripe.

8. A pin striping tool configured for applying a pinstripe onto a vehicle, said tool comprising:

a main body having a head portion, an interior cavity, and a slot in fluid communication between the head portion and the interior cavity of said main body, said slot being configured for receiving a wheel, said interior cavity being configured for receiving paint;

a wheel rotatably mounted in said slot with a portion of the periphery of said wheel extending into said interior cavity;

a shoulder extending from said main body;

a guide positioned on a surface of said vehicle, said guide being fabricated from plastic;

a guide nin extending from said shoulder, said guide pin being configured for riding at least one guide track formed in said guide, said at least one track defining a groove and being substantially parallel to the desired position of said pinstripe.

9. A pin striping tool configured for applying a pinstripe onto a vehicle, said tool comprising:

a main body having a head portion, an interior cavity, and a slot in fluid communication between the head portion and the interior cavity of said main body, said slot being configured for receiving a wheel, said interior cavity being configured for receiving paint;

a wheel rotatably mounted in said slot with a portion of the periphery of said wheel extending into said interior cavity;

a shoulder extending from said main body;

a guide positioned on a surface of said vehicle said guide having a strip fabricated from magnetic material for removably securing the guide to a metallic surface of said vehicle;

a guide pin extending from said shoulder, said guide nin being configured for riding at least one guide track formed in said guide, said at least one track defining a groove and being substantially parallel to the desired position of said pinstripe.

10. The tool of claim 1 wherein said shoulder is removable, re-useable, and replaceable.

11. The tool of claim 1 further comprising said guide having said at least one guide track formed therein, wherein said at least one guide track includes a first guide track and a second guide track, each of which guide tracks comprises a groove.

12. The tool of claim 1, wherein said shoulder and said head portion comprise corresponding snap portions that snap together and secure said shoulder in said head portion when said shoulder and said head portion are aligned.

13. A method for applying a pinstripe to a vehicle, the method comprising the steps of:

inserting a first end of a shoulder through a head portion of a main body of a paint striper, wherein the first end defines an axle for a wheel, and a second end comprises a guide pin;

rotatably mounting a wheel onto the axle of the shoulder so that at least a portion of the periphery of said wheel extends through a slot into an interior cavity of said paint striper;

communicating paint into said interior cavity of said main body of said paint striper;

positioning said guide pin in a guide track formed in a strip positioned on a surface of said vehicle, said guide track being substantially parallel to the desired position of said pinstripe; and moving the striper in a direction defined substantially by the direction of simultaneous movement of the guide pin in said guide track, to thereby apply a stripe of paint to the surface of the vehicle.

14. The method of claim 13 further comprising the step of applying adhesive to said guide to adhere said guide onto a surface of the vehicle.

15. The method of claim 13 further comprising the step of applying adhesive to said guide to adhere said guide onto a surface of the vehicle, wherein said adhesive is removable from said surface and re-usable on a surface of another vehicle.

16. The method of claim 13, wherein said paint is a first paint of a first color, said shoulder is a first shoulder, said wheel is a first wheel, and said method further comprises the steps of:

inserting a first end of a second shoulder through said head portion of said paint striper, wherein the length of said second shoulder is different from the length of said first shoulder, said first end defines an axle for a wheel, and a second end comprises a second guide pin;

rotatably mounting a second wheel onto the axle of said second shoulder so that at least a portion of the periphery of said second wheel extends through said slot into said interior cavity of said paint striper;

communicating a second paint of a second color into said interior cavity of said paint striper;

positioning said second guide pin in a guide track formed in a strip positioned on said surface of said vehicle, said guide track being substantially parallel to the desired position of said pinstripe; and moving the striper in a direction defined substantially by the direction of simultaneous movement of said guide pin in said guide track, to thereby apply a second stripe of paint to the surface of the vehicle.

17. The method of claim 13, wherein said paint is a first paint of a first color, said guide track is a first guide track, said wheel is a first wheel, and said method further comprises the steps of:

rotatably mounting a second wheel onto the axle of said shoulder so that at least a portion of the periphery of said second wheel extends through said slot into said interior cavity of said paint striper;

communicating a second paint of a second color into said interior cavity of said paint striper;

positioning said guide pin in a second guide track formed in said strip positioned on said surface of said vehicle, said track being substantially parallel to the desired position of said pinstripe; and moving the striper in a direction defined substantially by the direction of simultaneous movement of said guide pin in said guide track, to thereby apply a second stripe of paint to the surface of the vehicle.

18. The method of claim 13, further comprising the step of selecting wheel and shoulder sizes from a stripe size chart.

19. The method of claim 13, wherein the step of communicating paint into the cavity of the striper tool further comprises:

inserting a tube of paint into a tube retainer until a neck portion of the tube passes through a tube neck opening formed in the tube retainer;

inserting the tube retainer into the main body of the paint striper; and squeezing said tube to induce pressure to facilitate communication of paint from said tube into the said cavity.

20. The method of claim 13, wherein the step of communicating paint into the cavity of the striper tool further comprises:

inserting a tube of paint into a tube retainer until a neck portion of the tube passes through a tube neck opening formed in said tube retainer;

inserting said tube retainer into said main body of the paint striper so that said tube retainer is aligned with said main body; and squeezing said tube to induce pressure to facilitate communication of paint from said tube into the said cavity.

21. The method of claim 13, wherein the step of communicating paint into the cavity of the striper tool further comprises:

inserting a tube of paint into a tube retainer until a neck portion of the tube passes through a tube neck opening formed in said tube retainer;

inserting said tube retainer into said main body of the paint striper so that a post on said tube retainer is aligned with an alignment slot on said main body; and squeezing said tube to induce pressure to facilitate communication of paint from said tube into the said cavity.

22. The method of claim 13, wherein the step of communicating paint into said cavity of the striper tool further comprises:

inserting a tube of paint into a tube retainer until a neck portion of the tube passes through a tube neck opening formed in said tube retainer;

inserting said tube retainer into said main body of the paint striper so that a post on said main body is aligned with an alignment slot on said tube retainer; and squeezing said tube to induce pressure to facilitate communication of paint from said tube into the said cavity.

23. The method of claim 13, wherein said shoulder and said head portion comprises corresponding alignment snap portions, and wherein the step of inserting further comprises inserting said shoulder through said head portion until said shoulder snaps into place.

* * * * *